US009136657B2

(12) United States Patent
You

(10) Patent No.: US 9,136,657 B2
(45) Date of Patent: Sep. 15, 2015

(54) ANNULAR SIGNAL FEED MODULE

(71) Applicant: Bing You, Taoyuan County (TW)

(72) Inventor: Bing You, Taoyuan County (TW)

( * ) Notice: Subject to any disclaimer, the term of this patent is extended or adjusted under 35 U.S.C. 154(b) by 48 days.

(21) Appl. No.: 13/960,899

(22) Filed: Aug. 7, 2013

(65) Prior Publication Data

US 2014/0051306 A1 Feb. 20, 2014

(30) Foreign Application Priority Data

Aug. 14, 2012 (TW) ..... 101215684 U

(51) Int. Cl.

| | |
|---|---|
| ***H01R 24/58*** | (2011.01) |
| ***H01R 24/38*** | (2011.01) |
| ***H01R 31/06*** | (2006.01) |
| *H01R 13/622* | (2006.01) |

(52) U.S. Cl.

CPC ..... *H01R 24/58* (2013.01); *H01R 24/38* (2013.01); *H01R 31/06* (2013.01); *H01R 13/622* (2013.01)

(58) Field of Classification Search

CPC ..... H01R 24/58; H01R 2103/00; H01R 2105/00; H01R 2107/00; H01R 2201/12

USPC ..... 439/668, 669, 638

See application file for complete search history.

(56) References Cited

U.S. PATENT DOCUMENTS

| | | | | |
|---|---|---|---|---|
| 2,717,367 | A * | 9/1955 | Puerner | 439/668 |
| 2,815,494 | A * | 12/1957 | Hutchings | 439/669 |
| 2,912,668 | A * | 11/1959 | Eddy | 439/668 |
| 4,367,001 | A * | 1/1983 | Munakata | 439/638 |
| 4,518,217 | A * | 5/1985 | Corrigan, III | 439/668 |
| 4,683,587 | A * | 7/1987 | Silverman | 381/311 |
| 4,846,719 | A * | 7/1989 | Iwashita | 439/668 |
| 5,109,424 | A * | 4/1992 | Andre et al. | 381/384 |
| 5,273,452 | A * | 12/1993 | Donato et al. | 439/669 |
| 5,439,386 | A * | 8/1995 | Ellis et al. | 439/578 |
| 6,149,469 | A * | 11/2000 | Kim | 439/668 |
| 7,425,153 | B1 * | 9/2008 | Miller | 439/669 |
| 7,871,299 | B2 * | 1/2011 | Kawasaki et al. | 439/669 |
| 2005/0064764 | A1 * | 3/2005 | Shinohara | 439/669 |
| 2006/0246774 | A1 * | 11/2006 | Buck | 439/578 |
| 2011/0059648 | A1 * | 3/2011 | Montena | 439/668 |
| 2012/0021618 | A1 * | 1/2012 | Schultz | 439/38 |

FOREIGN PATENT DOCUMENTS

| | | |
|---|---|---|
| TW | 419356 M | 12/2011 |

* cited by examiner

*Primary Examiner* — Briggitte R Hammond
(74) *Attorney, Agent, or Firm* — Morton J. Rosenberg

(57) ABSTRACT

An annular signal feed module is composed of a jack and a plug. The annular signal feed module includes the signal feed function of the traditional headphone. Besides, there is no jack hole in construction so that the moisture, water and dust intrusion are incapable to corrode and immerse the contacts and internal circuit parts, therefore, prolong the durability of the headphone signal feed device and the related electronic apparatuses such as televisions, stereos, cell phones and so forth. The present annular signal feed module is designed to integrate the features pertaining to no jack hole in construction of previous model patent certification no. M419356, and simplify the structural complexity, more than those, less modifications from traditional molds make it easier and convenient to be manufactured than product of patent no. M419356.

6 Claims, 3 Drawing Sheets

ANNULAR SIGNAL FEED MODULE

CROSS-REFERENCE TO RELATED APPLICATION

This application claims the priority benefit of Taiwan application serial no. 101215684, filed on Aug. 14, 2012. The entirety of the above-mentioned patent application is hereby incorporated by reference herein and made a part of this specification.

BACKGROUND OF THE INVENTION

1. Field of the Invention

The present invention relates to an annular signal feed module; in particular, to a signal feed module between the headphone plug and the headphone jack without the jack hole. The structure to the signal feed module can prevent the corrosion to the contacts and circuit parts from the moisture, water and dust immersion, thus, prolong the durability to the parts of headphone and electronic circuits.

2. Descriptions of Related Art

Traditional headphone jack-plug is shown in FIG. 1. The plug includes plug left channel L, plug right channel R and plug ground G; the jack includes jack left channel Ls, jack right channel Rs, jack ground G, speaker left channel Lsp and speaker right channel Rsp. When the plug by left side is inserted in, it cuts the circuit of jack left channel Ls to speaker left channel Lsp and the circuit of jack right channel Rs to speaker right channel Rsp to mute the speaker that results in the signals from both jack left channel Ls and jack right channel Rs being transmitted to both plug left channel L and plug right channel R so as to sound the headphone. The moisture, water, dust or perspiration immersing into the jack of mobile phone, walkman or MP3 will make the contacts (Ls, Lsp, Rs, Rsp) oxidation, elastic fatigue even be damaged, it leads the headphone poor contact and sound intermittent or rattling. Besides, when the plug is pulled out, the speaker ought to sound normally, but if the jack spring was oxidized or elastic fatigue, the speaker will also sound intermittent or rattling. Additionally, the moisture immersing into the jack will corrode the internal circuit parts and cause the whole machinery failure, next, shorten the durability, even, adding insult to injury. To the worse, once the water is poured into the jack hole would damage the internal circuits directly.

Although Taiwan patent certification no. M419356 has reformed the disadvantages about the jack-plug structure in traditional headphone—the immersion by the moisture and dust to corrode the internal contacts. However, over half a century, the traditional jack-plug structure becomes universal and brings about varieties of the headphone molds. Fully updated to the framework of Taiwan patent certification no. M419356 will lead to change all the molds of the jack-plug structure in traditional headphone. In addition, the manufacturing complexity of this product-no. M419356 is high.

SUMMARY OF THE INVENTION

An annular signal feed module of the present invention not only reserves the non-jack hole feature of Taiwan patent certification no. M419356 but also simplifies the structural complexity, more than those, less modifications from traditional molds make it easier and convenient to be manufactured than product of patent no. M419356.

In order to understand the techniques, methods, and efficacy taken further in the present invention to achieve the purpose, the following embodiments are provided along with specifications, illustrations, object features and characteristics to facilitate the disclosure of the present invention. However, the accompanying drawings and attachments are only provided for reference and description and not intended to limit the present invention.

BRIEF DESCRIPTION OF THE DRAWINGS

FIG. 2A shows a schematic diagram according to an embodiment of the annular signal feed module of the present invention in the state that before the plug is screwed in;

FIG. 2B shows a schematic diagram according to an embodiment of the annular signal feed module of the present invention in the state that after the plug is screwed in;

DETAILED DESCRIPTION OF THE EMBODIMENTS

Figure 1:
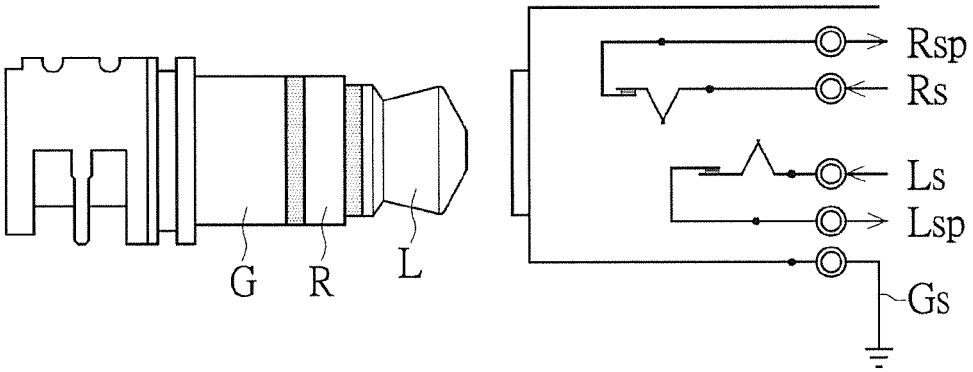
FIG.1 PRIOR ART
FIG. 1 shows a schematic diagram of the jack-plug structure in traditional headphone.
Figure 2A:
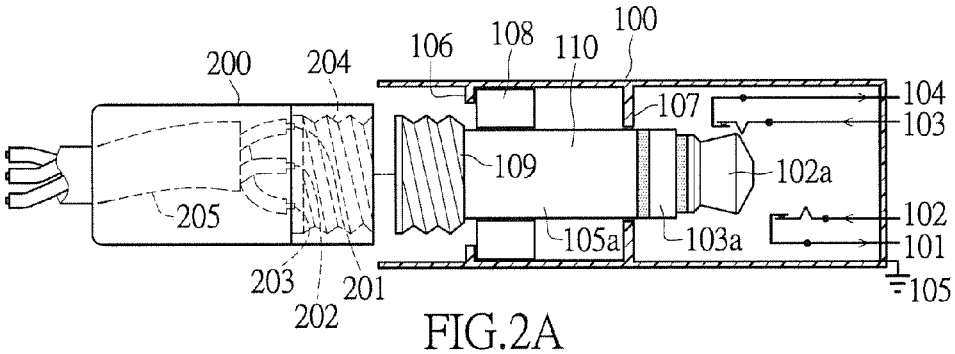
Figure 2B:
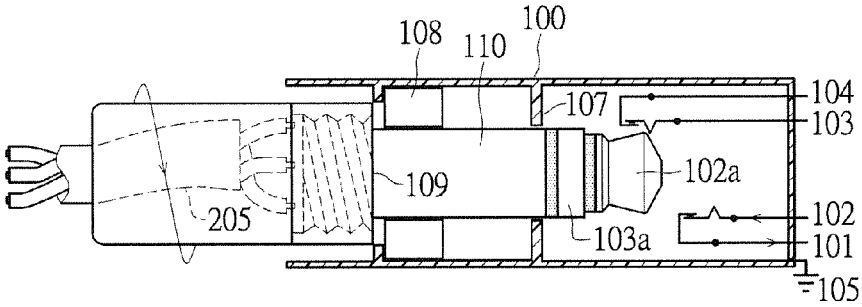
Figure 2C:
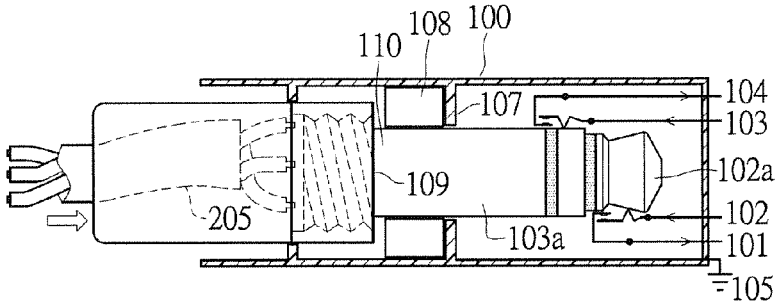
FIG. 2C shows a schematic diagram according to an embodiment of the annular signal feed module of the present invention in the state that after the plug is screwed in and pushed the tappet.
Figure 3B:
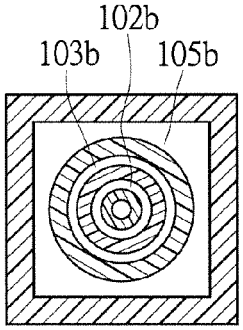
FIG. 3B shows a cutaway view according to AA line segment in FIG. 3A.
Figure 3A:
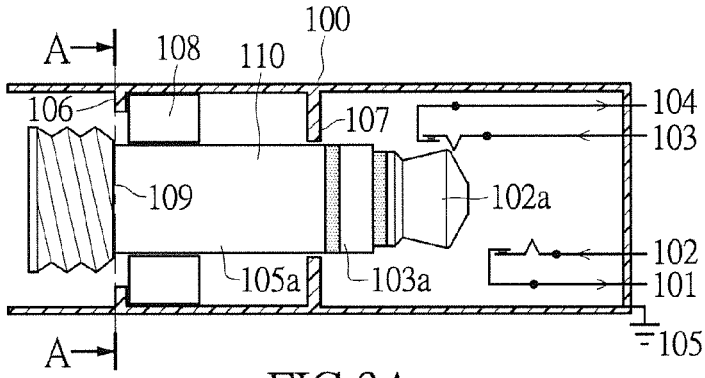
FIG. 3A shows a inside view according to an embodiment of the jack of the present invention.

Please refer to FIGS. 2A, 2B and 2C, the present invention provides an annular signal feed module between the headphone plug and the headphone jack without the jack hole, which the module includes:

The jack 100 as shown in FIG. 2A on the right, which the signal transmission element includes the speaker left channel terminal 101, the jack left channel terminal 102, the jack right channel terminal 103, the speaker right channel terminal 104, the jack ground terminal 105, the tappet left channel terminal 102*a*, the tappet right channel terminal 103*a*, the tappet ground terminal 105*a*, the left block 106, the right block 107, the tappet frame 108 and the tappet spiral 109. More specifically, please refer FIGS. 3A and 3B, which are the inside view of the jack 100 and the cutaway view according to AA line segment, there are the annular ground terminal 105*b*, the annular left channel terminal 102*b* and the annular right channel terminal 103*b* arranged on a receiving surface (the section of AA line segment) of the tappet 110.

Figure 4A:
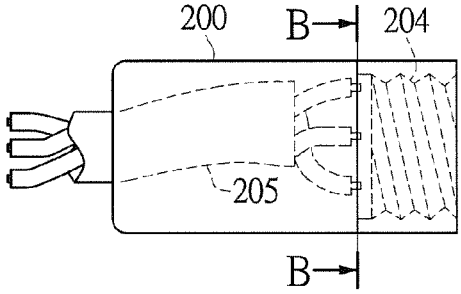
FIG. 4A shows a perspective view according to an embodiment of the plug of the present invention.
Figure 4B:
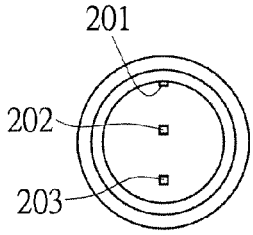
FIG. 4B shows a cutaway view according to BB line segment in FIG. 4A.

The plug 200 as shown in FIG. 2A on the left, which the signal receiving element includes the plug ground terminal 201, the plug left channel terminal 202, the plug right channel terminal 203, the plug inner spiral 204 and the plug inner wires 205. More specifically, please referring to FIGS. 4A and 4B, which are the inside view of the plug 200 and the cutaway view according to BB line segment, the plug inner wires 205 includes the plug ground terminal 201, the plug left channel terminal 202 and the plug right channel terminal 203, and the arrangement of the plug inner wires 205 at the section of BB line segment is shown as FIG. 4B.

Operation principle: in the state that the tappet 110 and the tappet frame 108 contacts to the left block 106, as shown in FIG. 2A, the tappet 110 could block the hole on left side of the jack and prevent the moisture and dust from immersing in, that is, the tappet 110 and the tappet frame 108 could seal the jack 100; when the plug 200 is screwed in, as shown in FIGS.

2B and 2D, the plug ground terminal 201, the plug left channel terminal 202 and the plug right channel terminal 203 come to contact with the annular ground terminal 105*b*, the annular left channel terminal 102*b* and the annular right channel terminal 103*b* respectively; after the plug 200 being pushed into the right side the tappet 110 and the tappet frame 108 will contact to the right block 107, as shown in FIG. 2C, and the tappet 110 will cut the circuit from the jack left channel terminal 102 to the speaker left channel terminal 101 and the circuit from the jack right channel terminal 103 to the speaker right channel terminal 104 therefore mute the speaker, and the signal from the jack left channel terminal 102 and the jack right channel terminal 103 will be transmitted to the tappet left channel terminal 102*a* and the tappet right channel terminal 103*a,* and then through the annular left channel terminal 102*b* and the annular right channel terminal 103*b* to the plug ground terminal 201 and the plug left channel terminal 202, and finally sound the headphone via the plug inner wires 205; besides, the ground signal is transmitted from the jack ground terminal 105 to the left block 106, the right block 107 and the tappet frame 108, and then through the annular ground terminal 105*b* to the plug ground terminal 201, finally, to the headphone via the plug inner wires 205.

The foregoing is only possible embodiments of the present invention, where any modifications and alterations in accordance with the claims of the present invention are also belong to the scope of the present invention.

What is claimed is:

1. An annular signal feed module comprising:

a threaded plug having a plug main body and a wire set, said wire set arranged in the plug main body; and a jack having a jack main body and a tappet displaceable within said jack main body, said jack including a tappet frame for engaging a portion of said tappet and an inner wall of said jack main body, said tappet frame fixed to said portion of said tappet and displaceable relative to said inner wall of said jack, said tappet having a receiving surface disposed with annular terminals;

whereby said tappet frame sealingly engages said tappet within said tappet main body;

wherein the threaded plug is threadedly coupled to the receiving surface of the tappet and electrically connects the plug to the jack through the wires set contacting the annular terminals.

2. The annular signal feed module according to claim 1, wherein the plug further comprises an inner spiral and the jack further comprises a spiral portion, and the plug is locked with the jack through the inner spiral screwing to the spiral portion.

3. The annular signal feed module according to claim 1, wherein the threaded plug is a headphone plug and the jack is a headphone jack.

4. The annular signal feed module according to claim 3, wherein the wire set includes a plug ground terminal, a plug left channel terminal, and a plug right channel terminal;

wherein the tappet includes a tappet left channel terminal, a tappet right channel terminal, and a tappet ground terminal; wherein the annular terminals include a annular left channel terminal, a annular right channel terminal, and a annular ground terminal.

5. The annular signal feed module according to claim 4, further comprising a left block and a right block, the left block and the right block are set inside the jack main body and form a reciprocating space, wherein the reciprocating space accommodates said tappet frame and limits said tappet frame driving said tappet to move reciprocating inside the reciprocating space.

6. The annular signal feed module according to claim 5, wherein a speaker left channel terminal, a jack left channel terminal, a jack right channel terminal, a speaker right channel terminal, and a jack ground terminal are set inside the jack main body; wherein the tappet left channel terminal is electrically connected to the annular left channel terminal, the tappet right channel terminal electrically connected to the annular right channel terminal, the tappet ground terminal is electrically connected to the annular ground terminal.

* * * * *